United States Patent [19]

Rokita

[11] Patent Number: 4,939,959

[45] Date of Patent: Jul. 10, 1990

[54] FASTENER HOLDING TOOL

[76] Inventor: Stephen Rokita, P.O. Box 100, Sussex, N.J. 07461

[21] Appl. No.: 419,318

[22] Filed: Oct. 10, 1989

[51] Int. Cl.[5] ..... B25B 23/10

[52] U.S. Cl. ..... 81/44; 81/13

[58] Field of Search ..... 81/13, 44, 451, 456; 254/18, 21, 25

[56] References Cited

U.S. PATENT DOCUMENTS 2,461,639 2/1949 Grigalunas ..... 7/169

3,730,237 5/1973 Hanzlik ..... 81/456

*Primary Examiner*—Roscoe V. Parker

*Attorney, Agent, or Firm*—Siegmar Silber

[57] ABSTRACT

A hand tool for removing improperly installed fasteners, i.e., fasteners which are loosely or freely mounted in the surrounding medium. The hand tool has a pair of jaws and a lever which securely holds the improperly installed or mounted fastener for purposes of removal.

15 Claims, 1 Drawing Sheet

FASTENER HOLDING TOOL

BACKGROUND OF THE INVENTION

1. Field of the Invention

This invention relates to a hand tool for removing improperly installed fasteners and more specifically for removing fasteners which are loosely or freely mounted in the surrounding medium. In such a case, when a removal tool is applied thereto, the fasteners spin rather than retract from the surrounding medium. The hand tool has a pair of jaws and a lever arrangement which securely holds the improperly installed or mounted fastener for purposes of removal.

2. Disclosure Information Statement

The inventor is and has been engaged in the residential hardware industry for the past twenty or so years. In reviewing catalogs of various manufacturers during this period, no hand tool of the nature disclosed herein has been uncovered. The need for the fastener holding hand tool is apparent from the discussion which follows. In applying metalworking screws, wood screws, bolts, nuts and bolts, and wall anchors, frequently the threaded mating portion of the surrounding medium becomes worn (or in the case of metal surfaces "stripped") and craftsmen working in these media have problems removing fasteners. At times the structure or the working conditions precludes use of a pair of pliers or a similar device to grasp the head of the fastener while applying the removal tool, e.g. screwdriver, nut driver, Allen head wrench or the like. Additionally, such use of auxiliary tools is at best awkward.

The present invention provides a specific tool for the purpose of holding fasteners which have become difficult to remove.

SUMMARY

The hand tool disclosed herein is for removing fasteners from surrounding media, which fasteners because of the condition of the fasteners and/or the surrounding media have become difficult of removal. The hand tool has an elongated tool body with one end thereof forming a tool handle. At the other end, a pair of spaced jaws are attached so that the jaws are substantially flat and lie within a plane which is normal or substantially normal to the longitudinal axis of the tool handle. The tool handle has a channel therethrough permitting the insertion of a removal tool so that, once the fastener to be removed is held by the jaws a removal tool can be placed on the fastener head. In addition to the channel, an aperture in the face of the tool handle is provided for easy insertion into and withdrawal from the channel of the removal tool. At the juncture of the spaced jaws and the tool body a heel portion is formed about which the hand tool is pivoted and thereby enabling the hand tool, during the removal operation, to continue to exert pressure upon the fastener being removed. Thus, as a fastener is removed the holding tool pivots sufficiently to maintain the contact between the jaws and the fastener head. By using the hand tool in the manner described hereinabove the removal of such improperly installed or mounted fasteners is facilitated.

OBJECTS AND FEATURES OF THE INVENTION

It is an object of the invention to provide a hand tool to facilitate removal of fasteners which have become loosened from the surrounding medium.

It is a further object of the invention to provide a hand tool which is easy to use and improves efficiency of the workman.

It is a yet further object of the invention to provide a tool in which a fastener holding device is provided while access to the fastener head by a removal tool is enabled.

It is feature of the invention that fastener holding forces are applied parallel to the longitudinal axis of the fastener.

It is a further feature of the hand tool that fasteners are removed from sheetmetal with minimal disturbance of the surface thereof.

Other objects and features of the invention will become apparent upon the reading of the detailed description of the preferred embodiment which follows.

BRIEF DESCRIPTION OF THE DRAWINGS

In the drawings which follow, corresponding parts are given the same reference number throughout the various views.

DESCRIPTION OF THE PREFERRED EMBODIMENT

Figure 1:
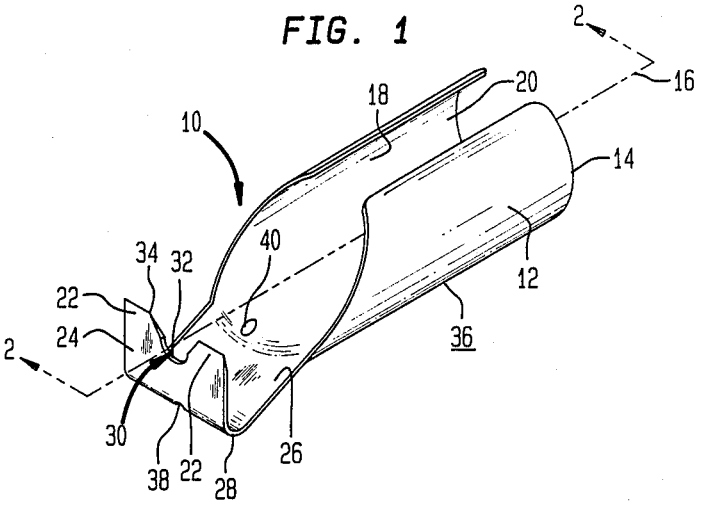
FIG. 1 is a perspective view of the fastener holding tool of this invention.
Figure 2:
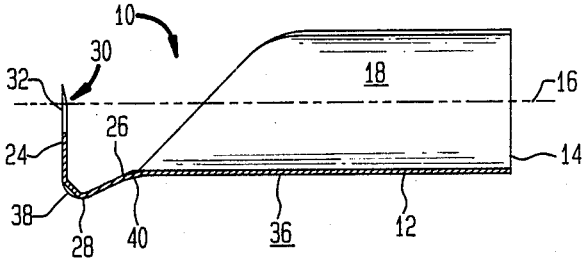
FIG. 2 is a cross sectional view taken along line 2—2 of FIG. 1.

Referring now to the drawings in greater detail and more particularly to drawings FIG. 1 and FIG. 2 thereof, the numeral 10 represents a fastener holding tool according to the present invention.

The fastener holding tool 10 is constructed having an elongated body 12 which body has a tool handle 14 about a longitudinal axis 16. Within the tool body a channel 18 extends coaxial with the longitudinal axis 16 and extends throughout the tool handle 14. In the face of the tool handle 14 an aperture 20 extends parallel to and connects with the channel 18 which aperture facilitates the insertion into and withdrawal from the channel of the removal tool. As shown in FIG. 1, the removal tool also includes a pair of space jaws 22 connected to one end of the tool handle 14. The jaws 22 are formed from a substantially flat blade-like portion 24 which in turn is in a plane substantially normal to the longitudinal axis 16. The jaws 22 are connected to the tool handle by a shaft or extender portion 26 and at the juncture of the shaft 26 and blade-like portion 24 there is formed a heel portion 28. The jaws as shown have a V-like throat 30 therebetween which throat terminates at a point or stop portion 32. The throat 30 is dimensioned so that the stop portion 32 is approximately coincident with the longitudinal axis 16. To facilitate grasping of the fastener, the interior of the space jaws 22 may have a bevel or a sharpened edge 34.

In constructing the tool 10, the extender portion 26 and the blade-like portion 24 may be constructed from a single web of sheetmetal 36 and, in order to preclude unbending one or more reinforcing indentations 38 are formed in the heel 26 portion. Similarly, when the entire tool is constructed from a single web of sheetmetal, an additional reinforcing indentation 40 is provided between the toolhandle 14 and the extender portion 26.

Figure 3:
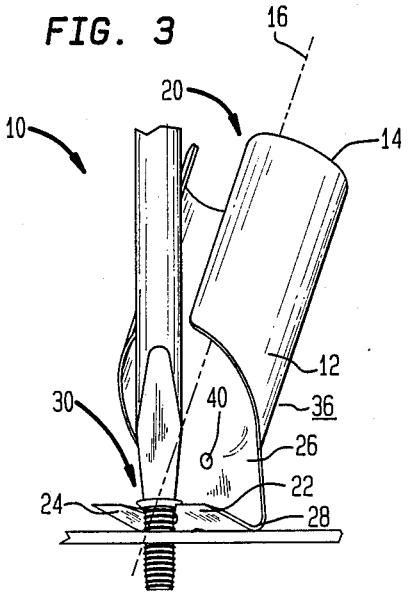
FIG. 3 is a detailed view showing the use of the tool during removal of a fastener with the removal tool in place and the fastener holding tool pivoted on the heel thereof.

In operation, the use of the fastener holding tool 10 is described with reference to FIG. 3. While the description of the operation is specific to the removal of a sheetmetal screw the same operational description applies to similar fastener removal problems with wood screws, wall anchors, or the like. Frequently, the adjacent medium in which the fastener is inserted or the fastener itself is corroded, stripped or eroded. In such cases, the attachment between the fastener and the surrounding medium is insufficient to allow normal removal of the fastener. In the example shown, the fastener holding tool is first inserted with the jaws 22 thereof surrounding the shaft of the fastener and the upper face of the jaws 22 urged against the fastener head. Thereafter, a fastener removal tool such as a screwdriver, Allen head wrench or nut driver is inserted through aperture 20 and channel 18 so that the head of the removal tool is seated upon the head of the fastener. Initially, the fastener holding tool will probably not be fully inserted so that the throat 30 is fully in contact with the fastener shaft; however, as removal of the fastener progresses the fastener tool 20 is pivoted slightly on heel 28 thereof and moves or "walks" so that the throat becomes fully seated with the shaft of the fastener abutting the stop 32 of the fastener tool 10. During removal of the fastener the fastener tool 10 is further shifted on heel 26 and thereby retains pressure against the fastener head in a direction parallel to the axis thereof.

Upon removal of the fastener, the removal tool is readily demounted from the fastener head and removed from the fastener holding tool through aperture 20 thereof.

While the tool shown is the best mode of the invention various changes may be made to the details of construction and it is understood that such changes will be in the spirit and scope of the invention. The invention is further defined by the claims appended hereto.

What is claimed is:

1. A fastener holding tool for removing an installed fastener from a surrounding medium to which the fastener is insufficiently attached to allow normal removal, said tool comprising, in combination:

an elongated tool body having one end portion thereof forming a tool handle;

a pair of spaced jaws attached at the other end of said elongated tool body, said jaws being substantially flat and lying within a plant substantially normal to the longitudinal axis of the tool handle;

a throat portion extending between said jaws for receiving the head of said fastener to be removed and for holding during removal said fastener;

channel means for inserting a removal tool through the handle, said channel means substantially coaxial with said longitudinal axis of said elongated tool body; and, a heel portion formed by the juncture of the jaws and the tool body and including one or more reinforcement indentations therein, said heel portion, upon the jaws receiving the fastener to be removed, dimensioned to pivot and to cause the fastener to grasp said surrounding medium;

whereby, the fastener holding tool holds the fastener to be removed with a force exerted parallel to the shaft of the fastener, and facilitates removal thereof.

2. A fastener holding tool as described in claim 1, wherein said jaws further comprise:

stop means for stopping travel of said fastener head and aligning the fastener substantially coaxially with said tool handle, said stop means at the base of said jaws.

3. A fastener holding tool as described in claim 2, wherein said elongated tool body further comprises:

a removal tool aperture in the face of said elongated tool body extending parallel to and connecting with said channel means to facilitate insertion into and withdrawal from the channel means of said removal tool.

4. A fastener holding tool as described in claim 1, wherein said tool body includes an extender portion connecting the tool handle and said spaced jaws.

5. A fastener holding tool as described in claim 4 wherein the juncture of the extender portion and the tool handle includes said one or more reinforcement indentations therein.

6. A tool accessory for use with a fastener removal tool in removing an installed fastener from a surrounding medium to which the fastener is insufficiently attached to allow normal removal, said tool accessory comprising, in combination:

an elongated tool body having one end portion thereof forming a tool handle;

a pair of spaced jaws attached at the other end of said elongated tool body, said jaws being substantially flat and lying within a plane substantially normal to the longitudinal axis of the tool handle;

a throat portion extending between said jaws for receiving the head of said fastener to be removed and for holding during removal said fastener;

a heel portion formed by the juncture of the jaws and the tool body and including one or more reinforcement indentations therein, said heel portion, upon the jaws receiving the fastener to be removed, dimensioned to pivot and to cause the fastener to grasp said surrounding medium;

whereby, the fastener holding tool holds the fastener to be removed with a force exerted parallel to the shaft of the fastener, and facilitates removal thereof.

7. A tool accessory as described in claim 6, wherein said jaws further comprise:

stop means for stopping travel of said fastener head and aligning the fastener substantially coaxially with said tool handle, said stop means at the base of said jaws.

8. A tool accessory as described in claim 6, wherein said elongated body further comprises:

channel means for inserting a removal tool through the handle, said channel means substantially coaxial with said longitudinal axis of said elongated tool body.

9. A tool accessory as described in claim 8, wherein said elongated tool body further comprises:

a removal tool aperture in the face of said elongated tool body extending parallel to and connecting with said channel means to facilitate insertion into and withdrawal from the channel means of said removal tool.

10. A tool accessory as described in claim 6, wherein said tool body includes an extender portion connecting the tool handle and said spaced jaws.

11. A tool accessory as described in claim 10 wherein the juncture of the extender portion and the tool handle includes said one or more reinforcement indentations therein.

12. A tool accessory for use with a fastener removal tool in removing an installed fastener from a surrounding medium to which the fastener is insufficiently attached to allow normal removal, said tool accessory comprising, in combination:

a web of sheetmetal, forming a tool accessory body in turn, comprising:

an elongated body portion having one end thereof formed into a semicylindrical tool handle;

an extender portion being substantially rectangular at one side to the medial portion of end of said semicylindrical tool handle and depending therefrom; and, a blade portion being substantially flat attached to said extender portion at the side opposite said tool handle attachment, said blade portion lying in a plane substantially normal to the longitudinal axis of the tool handle and including spaced jaws with the throat therebetween on the side opposite said extender portion attachment;

a heel portion at the juncture of the jaws and the tool body, said heel portion, upon the jaws receiving the fastener to be removed, dimensioned to pivot and to cause the fastener to grasp said surrounding medium; said juncture of the jaws and the tool body includes one or more reinforcement identations therein;

whereby, upon jaws receiving the fastener to be removed, the tool holds the fastener with a force exerted parallel to the shaft of the fastener, and facilitates removal thereof.

13. A tool accessory as described in claim 12, wherein said jaws further comprise:

stop means for stopping travel of said fastener head and aligning the fastener substantially coaxially with said tool handle, said stop means at the base of said jaws.

14. A tool accessory as described in claim 12, wherein said tool body includes an extender portion connecting the tool handle and said spaced jaws.

15. A tool accessory as described in claim 14 wherein the juncture of the extender portion and the tool handle includes said one or more reinforcement indentations therein.

* * * * *